US006940337B2

(12) United States Patent
Viswanathan et al.

(10) Patent No.: US 6,940,337 B2
(45) Date of Patent: Sep. 6, 2005

(54) LOAD SENSING VOLTAGE REGULATOR FOR PLL/DLL ARCHITECTURES

(75) Inventors: T. Lakshmi Viswanathan, Dallas, TX (US); Prasun K. Raha, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/749,275

(22) Filed: Dec. 29, 2003

(65) Prior Publication Data

US 2005/0140429 A1 Jun. 30, 2005

(51) Int. Cl.[7] ..... G05F 1/10
(52) U.S. Cl. ..... 327/541

(58) Field of Search ..... 327/530, 534, 327/535, 538, 540, 541, 543

(56) References Cited

U.S. PATENT DOCUMENTS 4,716,307 A * 12/1987 Aoyama ..... 327/543

* cited by examiner

*Primary Examiner*—Jeffrey Zweizig
(74) *Attorney, Agent, or Firm*—Alan K. Stewart; W. James Brady, III; Frederick J. Telecky, Jr.

(57) ABSTRACT

An apparatus includes a voltage regulator operable to regulate a supply voltage to an on-chip module having an operational current, draw a supply current, and supply the operation current to the on-chip module. The supply current drawn by the voltage regulator is proportional to the operating current of the on-chip module.

20 Claims, 3 Drawing Sheets

LOAD SENSING VOLTAGE REGULATOR FOR PLL/DLL ARCHITECTURES

TECHNICAL FIELD OF THE INVENTION

This invention relates in general to voltage regulators, and, more particularly, to a load sensing voltage regulator for PLL/DLL architectures.

BACKGROUND OF THE INVENTION

A phase-locked loop, or "PLL," is a closed loop frequency control system that controls an oscillator so that it maintains a constant phase angle relative to a reference signal. Typically, a PLL is used to generate a higher frequency clock that is used by a chip or digital device to perform computations or other operations.

FIG. 1 illustrates an example chip device 10 that includes, among other things, a digital block 12, a PLL 14, and a regulator 16. Digital block 12 may be any chip, set of chips, or other digital device operable to perform computations or other digital operations. PLL 14 generates clock signals 18 that are used to drive the computations or other operations performed by digital block 12. Regulator 16 serves multiple purposes. First, regulator 16 supplies an input current, $I_{PLL}$, to PLL 14 in order to drive PLL 14. Second, regulator 16 regulates the output voltage supplied to PLL 14, which may be referred to as $V_{OUT}$. Regulator 16 receives a high-voltage analog input voltage, $V_{DDAHV}$, and a reference voltage input, $V_{REF}$. The input voltage $V_{DDAHV}$ may be received from outside chip device 10, and is higher than the voltage output by regulator 16, $V_{OUT}$. The voltage $V_{REF}$ indicates to the regulator the desired output voltage, $V_{OUT}$. The output voltage of regulator 16, $V_{OUT}$, is thus ideally equal to, or approximately equal to, the reference voltage input, $V_{REF}$. Regulator 16 attempts to minimize variations in $V_{OUT}$ that may be caused by variations in $V_{DDAHV}$. In particular, regulator 16 attempts to minimize the power supply rejection ratio (PSRR), which is equal to the variation of $V_{OUT}$ divided by the variation of $V_{DDAHV}$, as shown below.

$$PSRR = \frac{\text{variation of } V_{OUT}}{\text{variation of } V_{DDAHV}} \tag{1}$$

In addition, regulator 16 attempts to hold $V_{OUT}$ constant over the range of the level of current, $I_{PLL}$, required by PLL 14 to operate over the specified frequency range under all possible conditions such as temperature ranges and processing variables.

FIG. 2 illustrates a typical circuit topography of regulator 16, which is referred to herein as a "enhanced source follower" topography. Regulator 16 includes a negative feedback loop, indicated at 30, that includes a high-gain operational amplifier (or "op-amp"), transistors 32 and 34, and an active load $I_2$. This negative feedback arrangement is well known to produce an output voltage, $V_{OUT}$, that closely approximates the reference input voltage, $V_{REF}$. Regulator 16 includes two current sources, $I_1$ and $I_2$, both of which are constant. $I_{LOAD}$ represents the current drawn by a load, such as PLL 14, for example (as discussed above with regard to FIG. 1).

This topography has a lower output impedance than a simple source follower using only a single transistor 32 and current source $I_1$. This is due to the additional negative feedback through the transistor 34 coupled with the fact that the bias current of transistor 32 is kept constant at $I_2$. Applying Kirchoff's law to the topography of regulator 16 yields:

$$I_1 = I_2 + I_3 + I_{LOAD} \tag{2}$$

Since $I_1$ and $I_2$ are constant, an increase in $I_{LOAD}$ (current demand) is reflected as a corresponding decrease in $I_3$, and vice versa.

In addition, from Equation (2) it can be seen that all of the current being drawn by PLL 14, namely $I_{LOAD}$, must come from the source current $I_1$. $I_1$ is therefore established as a fixed current sufficient to supply the maximum anticipated load current, $I_{LOAD}$ (i.e., the maximum anticipated current required by PLL, $I_{PLL}$), in addition to fixed current $I_2$.

With the arrangement shown in FIG. 2, the fixed supply current $I_1$ is drawn from the supply $V_{DDAHV}$ regardless of variations in the load current $I_{LOAD}$. Thus, when $I_{LOAD}$ is less than the maximum anticipated value for $I_{LOAD}$, I1 is drawing more current than is required. This extra current is dissipated by regulator 16 (largely by the not-illustrated transistor(s) needed to provide $I_1$), which is inefficient and generates undesired heat. It would therefore be desirable to have the source current of regulator 16 variable with the load current, $I_{LOAD}$ in order to conserve current and reduce power dissipation when the required $I_{LOAD}$ is lower than the maximum value, such as when PLL 14 operates at relatively low frequencies, for example.

SUMMARY OF THE INVENTION

In accordance with the present invention, a voltage regulator used to provide a regulated voltage and supply the required operating current to an on-chip module (such as a PLL or DLL, for example) is provided that draws a variable amount of source current, thus increasing the efficiency and reducing the amount of power dissipation within the regulator.

According to one embodiment, an apparatus includes a voltage regulator operable to regulate a supply voltage to an on-chip module having an operational current, draw a supply current, and supply the operation current to the on-chip module. The supply current drawn by the voltage regulator is proportional to the operating current of the on-chip module.

According to another embodiment, a method includes regulating a supply voltage to an on-chip module having an operational current, drawing a supply current, and supplying the operation current to the on-chip module. The supply current drawn by the voltage regulator is proportional to the operating current of the on-chip module.

Various embodiments of the present invention may benefit from numerous advantages. It should be noted that one or more embodiments may benefit from some, none, or all of the advantages discussed below.

One advantage is that a voltage regulator that supplies an on-chip module (such as a PLL or DLL, for example) with a regulated voltage draws a variable amount of source current, thus increasing the efficiency and reducing the amount of power dissipation within the regulator.

In addition, the operating current of the on-chip module is sensed by replicating and biasing a component of the on-chip device. The sensed current is then copied and used to derive the main component of the power supply current of the regulator. In certain embodiments, the maximum current that may be supplied by the regulator to the on-chip module varies with respect to the maximum operating current needed by the on-chip module over a range of anticipated operating parameters, such as processing parameters, the operating temperature of the on-chip module, the voltage supplied to the on-chip module, and the operating frequency of the on-chip module. Thus, when the on-chip module is operating at a set of operating parameters for which its maximum operating current is relatively low, the maximum current supplied by the regulator is reduced accordingly. As a result, current is saved and dissipation of power within the regulator is reduced.

In addition, the regulator provides the typical functionality of a voltage regulator. For example, the regulator regulates the voltage supplied to the on-chip module such that the power supply rejection ratio (PSRR) of the regulator is generally minimized.

Other advantages will be readily apparent to one having ordinary skill in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which.

DETAILED DESCRIPTION OF THE DRAWINGS

Example embodiments of the present invention and their advantages are best understood by referring now to FIGS. 1 through 5 of the drawings, in which like numerals refer to like parts.

Among other things, various embodiments of the present invention are directed toward a load sensing voltage regulator for PLL or DLL architectures. The voltage regulator is capable of sensing the operating current of the PLL or DLL and supplying a variable amount of current based on the sensed current.

Figure 1:
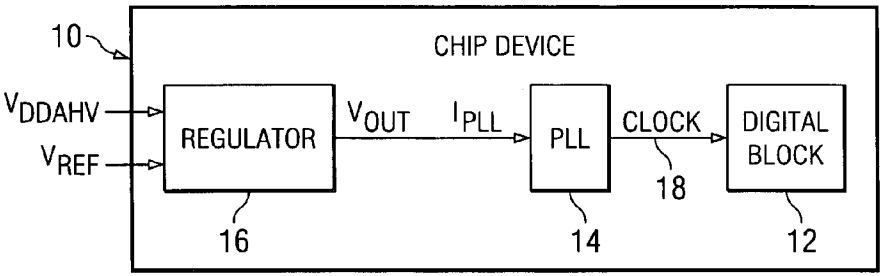
FIG. 1 (PRIOR ART)
FIG. 1 illustrates an example prior art chip device that includes, among other things, a digital block, a PLL, and a regulator.
Figure 2:
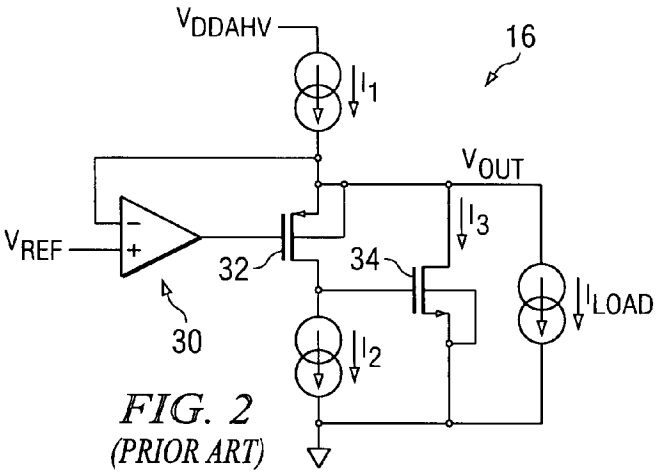
FIG. 2 (PRIOR ART)
FIG. 2 illustrates a typical circuit topography of a prior art regulator.
Figure 3:
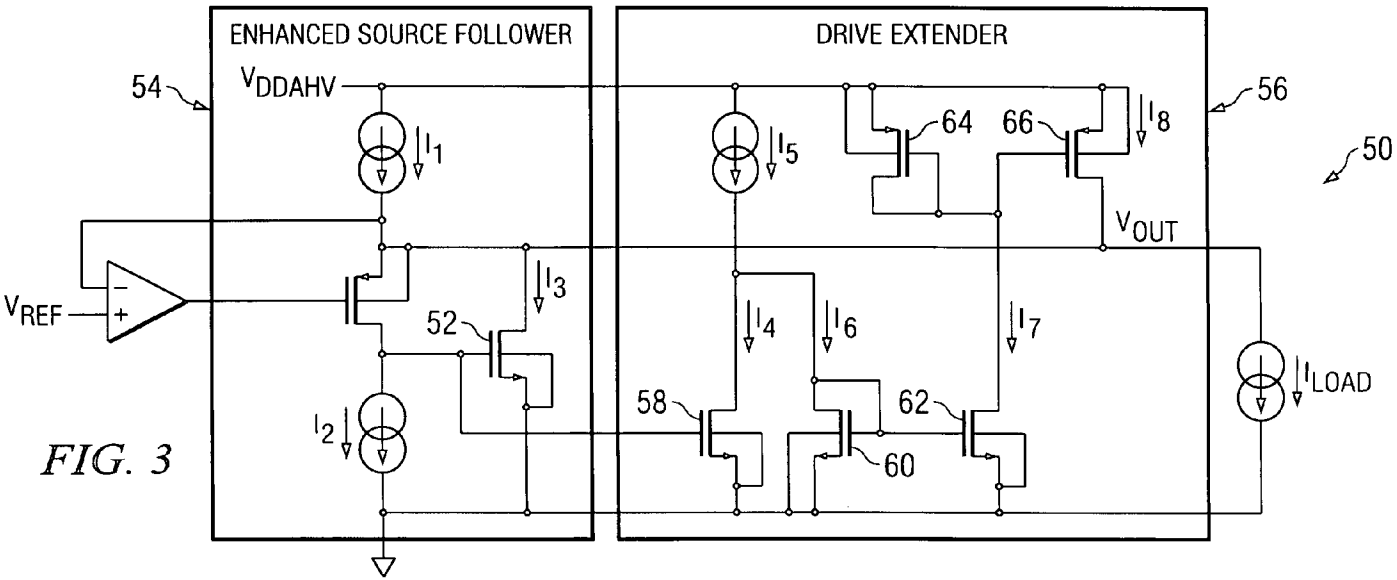
FIG. 3 illustrates the topography of an example regulator according to an embodiment of the present invention.

FIG. 3 illustrates the topography of an example regulator 50 according to an embodiment of the present invention. Regulator 50 is generally a modification of known regulator 16 (shown in FIG. 2) that enables the power supply current to be proportional to the load current, $I_{LOAD}$, starting from some minimum value. The design of regulator 50 is based on the fact that in prior art regulator 16, the gate voltage of transistor 32 (which is analogous to transistor 52 of regulator 50) is sensitive to changes in the load current, $I_{LOAD}$, as discussed above.

Regulator 50 includes the "enhanced source follower" topography of regulator 16, indicated generally by box 54, along with a "drive extender," indicated generally by box 56. Drive extender 56 includes various "current mirrors" which are designed to utilize the relationship between $I_3$ and $I_{LOAD}$ to create a proportional relationship between the power supply current of regulator 50 and the load current, $I_{LOAD}$. The term "current mirror" refers to the relationship between the current through two transistors that have identical gate-to-source voltage. Drive extender 56 also includes another fixed current, $I_5$, which is discussed below in greater detail.

The derivation of regulator 50 from regulator 16 includes the following steps. First, $I_3$ is copied to $I_4$ by creating a first current mirror between transistors 52 and 58. A fixed current, $I_5$, and a resulting current, $I_6$, are added to the circuit. $I_6$ is copied to $I_7$ by creating a second current mirror between transistors 60 and 62. $I_7$ is copied to I8 by creating a third current mirror between transistors 64 and 66.

The relative size of the pair of transistors forming each current mirror determines the proportionality constant between the corresponding currents. In this embodiment, transistors 52 and 58 are sized such that there is a proportionality constant (or multiplying factor) of "m" between I3 and I4. Similarly, transistors 60 and 62 are sized such that there is a proportionality constant of "k" between I6 and I7. Similarly, transistors 64 and 66 are sized such that there is a proportionality constant of "n" between I7 and I8. Thus, the following equations may be written:

$$I3=m*I4 \tag{3}$$

$$I6=k*I7 \tag{4}$$

$$I7=n*I8 \tag{5}$$

Based on Equations (3), (4) and (5) and applying Kirchoff's law at various points within the topography of regulator 50, the following equations can be written:

$$I_1+I_8=I_2+I_3+I_{LOAD} \tag{6}$$

$$I_8=(nk*I_5)-(nk/m)*I_3 \tag{7}$$

$$I_8=((nk/m)/(1+nk/m))*I_{LOAD}+(nk/(1+(nk/m))*I_5) \tag{8}$$

$$I_{LOAD_max}=(nk*I_5)+I_1-I_2 \text{ when } I_3=0 \tag{9}$$

Figure 4:
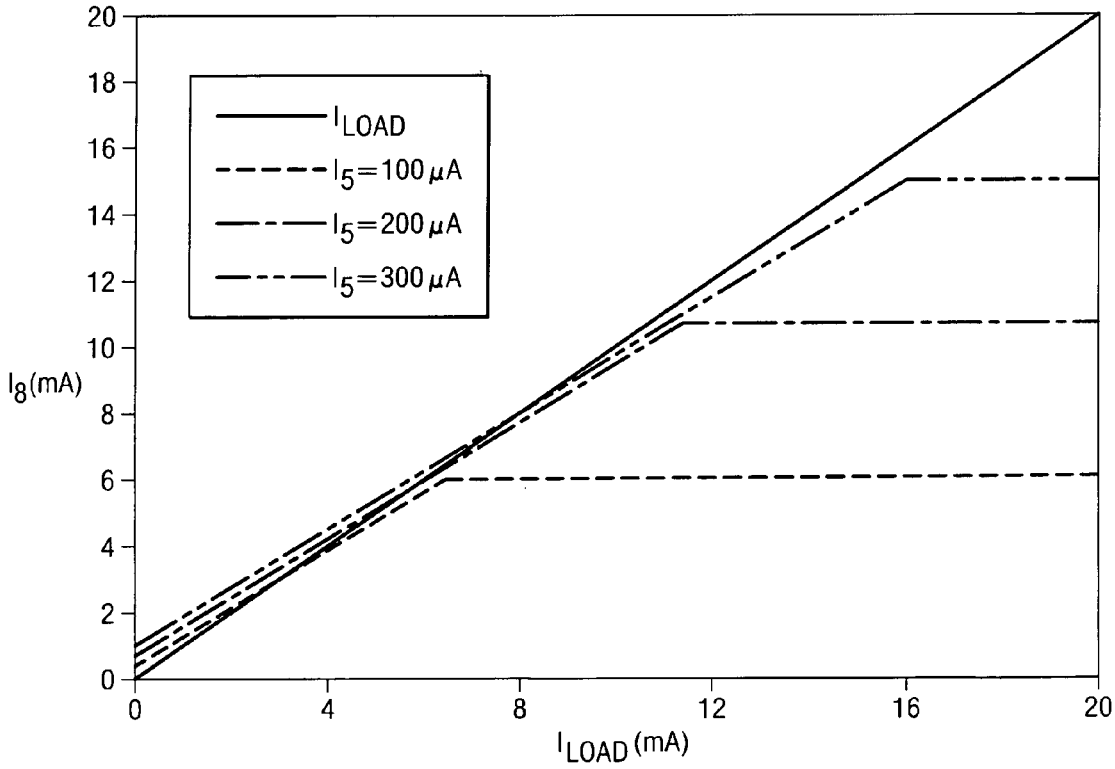
FIG. 4 is an example graph of illustrating the relationship between $I_8$ and $I_{LOAD}$ for various values of $I_5$.

Assuming that $I_5$ is constant, Equation (8) is a linear equation in the form of y=mx+b, where y is represented by $I_8$ and x is represented by $I_{LOAD}$. Thus, it can be seen that $I_8$ is proportional to $I_{LOAD}$. FIG. 4 is an example graph of Equation (8) for different values of $I_5$ to illustrate the relationship between $I_8$ and $I_{LOAD}$. For each value of $I_5$, the value of $I_8$ saturates when $I_3$ becomes zero, as shown in Equation (9) above.

Equation (6) illustrates that the power supply current is $I_1+I_8$, as opposed to only $I_1$ as in prior art regulator 16, as discussed above. In addition, in Equation (9), $(nk*I_5)$ is the dominant term as it includes the multipliers "n" and "k." Further, from Equation (7), $I_8=(nk*I_5)$ when $I_3=0$. Taken together, these equations therefore illustrate that $I_8$ is the dominant portion of the power supply current.

In other words, most of the load current, $I_{LOAD}$, is supplied by $I_8$, which is proportional to $I_{LOAD}$ as discussed above. Because $I_8$ is the large component of the source current supplying $I_{LOAD}$, the voltage regulation performed by the "enhanced source follower" portion 54 of regulator 50 may be performed with relatively low current, $I_1$. In other words, $I_1$ is a relatively small constant current that powers the voltage regulation functionality of regulator 16, while $I_8$ is a relatively large variable current that supplies most of the load current, $I_{LOAD}$.

The design of regulator 50 provides several additional benefits. First, regulator 50 generates only the current demanded by the load, $I_{LOAD}$. Second, $I_5$ may be set based on the maximum anticipated load current. In particular, $I_5$ may be set such that $I_8$ is sufficient to supply this maximum anticipated load current based on the known relationship between $I_5$ and $I_8$ ($I_8$=(nk*$I_5$)) at the maximum load current state.

For example, if regulator 50 is used to power a PLL such that the operating current of the PLL, $I_{PLL}$, is the load current of regulator 50, $I_5$ may be set based on the maximum anticipated operating current of the PLL. The maximum operating current of a PLL, $I_{PLL_max}$, varies based on a variety of operating parameters, such as the details of the silicon processing for the PLL, the temperature of the PLL, the voltage applied to the PLL, and/or the frequency at which the PLL is operating, for example. The maximum operating current of the PLL, $I_{PLL}$ max, may be determined across the anticipated ranges of such parameters in order to determine the overall maximum anticipated operating current, which may be referred to as $I_{PLL_max_ant}$. Thus, $I_{PLL_max_ant}$ corresponds with the state of the PLL at which the combination of operating parameters, within the anticipated ranges of such parameters, requires the greatest amount of current.

Once $I_{PLL_max_ant}$ is determined or estimated, $I_5$ may be set at a value equal to ($I_{PLL_max_ant}$)/nk. Thus, at that maximum operating current state, $I_8$=nk*$I_5$, which equals $I_{PLL_max_ant}$. As a result, regulator 70 is capable of supplying the PLL with sufficient power for all anticipated or foreseeable circumstances regarding the fabrication and operation of the PLL.

Figure 5:
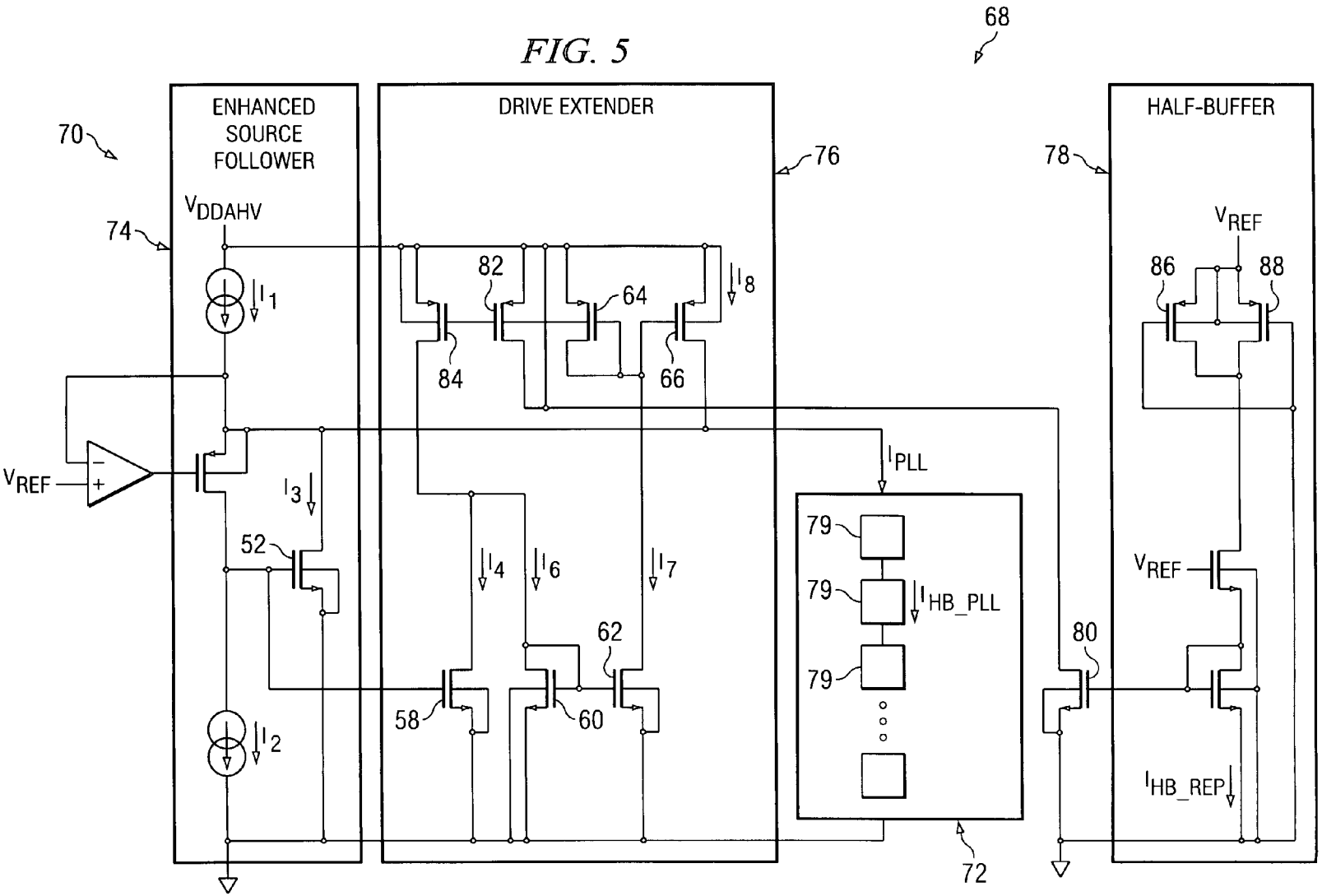
FIG. 5 illustrates an example system including a regulator, a PLL and a replicated half-buffer in accordance with the present invention.

An example system of controlling $I_5$ to increase the efficiency of the regulator is shown in FIG. 5. FIG. 5 illustrates an example system 60 including a regulator 70, a PLL 72 and a half-buffer 78. Regulator 70 is generally operable to regulate output voltage, $V_{OUT}$, and supply operating current to a PLL 72. Regulator 70 includes a "enhanced source follower" portion 74 and a "drive extender" 76. Regulator 70 is similar to regulator 50, except that current $I_5$ in regulator 70 is controlled by the current of half-buffer 78, as described below, rather than being a fixed current as in regulator 50.

A PLL typically includes a number of identical stages, such as buffers or half-buffers. The maximum current needed by the PLL at any given time is equal to the current needed by each stage, multiplied by the number of stages. In the embodiment shown in FIG. 5, PLL 72 includes forty half-buffers 79. Thus, the maximum anticipated operating current of PLL 72, which may be indicated as $I_{PLL_max}$, is equal to the operating current at any half-buffer 79, $I_{HB_PLL}$, when PLL 72 is operating at the highest anticipated frequency, and multiplying by forty.

Half-buffer 78 is a replica of one of the half-buffers 79 within PLL 72. In certain embodiments, replica half-buffer 78 is (1) fabricated along with half-buffers 79 of PLL 72 such that the half-buffer 78 has the same silicon processing parameters as half-buffers 79; and (2) located proximate PLL 72 such that the operating temperature of half-buffer 78 is similar to that of half-buffers 79.

Half-buffer 78 includes p-channel transistors 86 and 88, each of which has a gate-to-source voltage that is set to the maximum value, $V_{REF}$ (which is the same as the reference voltage, $V_{REF}$, supplied to regulator 70). Thus, the current drawn by half-buffer 78 is equal to the maximum operating current (in other words, the operating current when PLL 72 is operating at the maximum anticipated frequency) of the replicated half-buffer 79, which may be referred to as $I_{HB_PLL_max}$, across the anticipated ranges of processing, temperature, and voltage parameters. In other words, the operational current of half-buffer 78, $I_{HB_REP}$, at any particular combination of anticipated processing, temperature, and voltage parameters, is equal to the maximum operating current, $I_{HB_PLL_max}$, of the replicated half-buffer 79 operating at the same processing, temperature, and voltage parameters.

Replica half-buffer 78 may be used to derive $I_5$ in any suitable manner. For example, as shown in FIG. 5, the operating current of replica half-buffer 78, $I_{HB_REP}$, is copied by creating a first current mirror using a transistor 80 and again copied to provide $I_5$ by creating a second current mirror using transistors 82 and 84. In this manner, $I_{HB_REP}$ is sensed and copied as $I_5$, which is used by regulator 70.

Thus, $I_5$ in regulator 70 is equal to $I_{HB_REP}$, which, as discussed above, is equal to the maximum anticipated operating current of each half-buffer 79, $I_{HB_PLL_max}$. Since $I_{HB_PLL_max}$, represents only 1/40 of the maximum operating current of PLL 72, $I_{PLL_max}$, transistors 60, 62, 64 and 66 are sized such that the product of multiplying factors "n" and "k" equals 40. Thus, since $I_8$=(nk*$I_5$)−(nk/m)*$I_3$ (see Equation (7) above), the maximum current that can be supplied to PLL 72 by $I_8$ is 40*($I_5$), which equals 40*($I_{HB_REP}$), which equals 40*($I_{HB_PLL\text{-}max}$), which equals $I_{PLL_max}$. Thus, the maximum value of $I_8$, $I_{_max}$, is equal to the maximum operating current of PLL 72, $I_{PLL_max}$, over the anticipated ranges of process, temperature, voltage and frequency parameters of PLL 72. In other words, $I_8$ is able to supply the maximum current required by PLL 72, over the anticipated ranges of process, temperature, voltage and frequency parameters of PLL 72.

Regulator 70 provides several advantages. First, the operating current of replica half-buffer 79 is sensed and copied to derive $I_8$ (via $I_5$), which is the main component of the power supply current of regulator 70. Thus, the maximum current that may be supplied by $I_8$ varies with respect to the maximum current needed by PLL 72, $I_{PLL_max}$, over the anticipated ranges of process, temperature, voltage and frequency parameters associated with PLL 72. Thus, when PLL 72 is operating at a set of operating parameters for which the maximum operating current of PLL 72 is relatively low, maximum current supplied by $I_8$ is reduced accordingly. As a result, current is saved and dissipation of power within regulator 70 is reduced as compared with prior art regulators, such as regulator 16 shown in FIG. 2, for example.

In addition, regulator 70 provides the typical functionality of a voltage regulator. For example, regulator 70 regulates the output voltage, $V_{OUT}$, such that it closely approximates the input reference voltage, $V_{REF}$. In addition, the power supply rejection ratio (PSRR) of regulator 70 is generally minimized with respect to the high-voltage analog input voltage, $V_{DDAHV}$.

It should be understood that although regulator 70 is shown and discussed herein as being provided to supply voltage and current to a PLL device 72, the architecture of regulator 70 may similarly be used to supply voltage and current to any other suitable on-chip functional modules, such as delay-locked loop (DLL) devices or data converters, for example, within the scope of the present invention.

In addition, it should be understood that regulator 70 may be used in a variety of ASIC applications, including both CMOS devices and bipolar circuits, for example.

Although embodiments of the invention and its advantages have been described in detail, a person skilled in the art could make various alterations, additions, and omissions without departing from the spirit and scope of the present invention as defined by the appended claims.

What is claimed is:

1. An apparatus, comprising:

a voltage regulator operable to:

regulate a supply voltage to an on-chip module having an operational current;

draw a supply current; and supply the operation current to the on-chip module;

wherein the supply current drawn by the voltage regulator is proportional to the operating current of the on-chip module;

wherein the voltage regulator includes:

a source follower portion generally operable to regulate the supply voltage to the on-chip module; and a drive extender portion generally operable to draw a supply current proportional to the operating current of the on-chip module in order to supply the operating current to the on-chip module.

2. The apparatus of claim 1, wherein the supply current drawn by the voltage regulator includes:

a fixed current component; and a variable current component that varies in proportion to the operating current of the on-chip module.

3. The apparatus of claim 2, wherein the variable current component of the source current supplies most of the operating current of the on-chip module during the operation of the on-chip module.

4. The apparatus of claim 2, wherein:

the fixed current component of the source current is generally used to regulate the supply voltage to the on-chip module; and the variable current component of the source current is generally used to supply the operational current of the on-chip module.

5. The apparatus of claim 1, further comprising a current source that supplies the voltage regulator with a variable source current; and wherein the voltage regulator supplies the operating current of the on-chip module based at least on the variable source current.

6. The apparatus of claim 5, wherein the maximum current that can be supplied to the on-chip module by the voltage generator varies based on the variable source current received from the current source.

7. The apparatus of claim 5, wherein the current source is a replica of a component of the on-chip module and is biased such that the variable source current supplied by the current source to the voltage regulator is equal to the maximum anticipated operational current required by the on-chip module, the maximum anticipated operational current required by the on-chip module being defined as the operational current of the on-chip module when the on-chip module operates at its maximum anticipated frequency.

8. The apparatus of claim 7, wherein:

the current source is fabricated along with the on-chip module such that that the silicon processing characteristics of the current source are similar to those of the replicated component of the on-chip module; and the current source is located proximate the on-chip module such that the operating temperature of the current source is similar to that of the replicated component of the on-chip module.

9. The apparatus of claim 5, wherein:

the on-chip module is a phase-locked loop device including a plurality of half-buffers; and the current source is a replica of one of the plurality of half-buffers.

10. The apparatus of claim 5, wherein the on-chip module is a delay-locked loop device.

11. A method, comprising:

regulating a supply voltage to an on-chip module having an operational current;

drawing a supply current; and supplying the operation current to the on-chip module;

wherein the supply current drawn by the voltage regulator is proportional to the operating current of the on-chip module;

receiving a variable source current from a current source; and supplying the operating current of the on-chip module based at least on the received variable source current.

12. The method of claim 11, wherein drawing the supply current includes:

drawing a fixed current component of the supply current; and drawing a variable current component of the supply current, wherein the variable current component varies in proportion to the operating current of the on-chip module.

13. The method of claim 12, further comprising:

using the fixed current component of the source to regulate the supply voltage to the on-chip module; and using the variable current component of the source current to supply the operational current of the on-chip module.

14. The method of claim 11, wherein the maximum current that can be supplied to the on-chip module by the voltage generator varies based on the variable source current received from the current source.

15. The method of claim 11, wherein:

the current source is a replica of a component of the on-chip module; and the method further comprises biasing the current source such that the variable source current supplied by the current source to the voltage regulator is equal to the maximum anticipated operational current required by the on-chip module, the maximum anticipated operational current required by the on-chip module being defined as the operational current of the on-chip module when the on-chip module operates at its maximum anticipated frequency.

16. The method of claim 11, further comprising:

fabricated the current source along with the on-chip module such that that the silicon processing characteristics of the current source are similar to those of the replicated component of the on-chip module; and locating the current source proximate the on-chip module such that the operating temperature of the current source is similar to that of the replicated component of the on-chip module.

17. The method of claim 11, wherein:

the on-chip module is a phase-locked loop device including a plurality of half-buffers; and the current source is a replica of one of the plurality of half-buffers.

18. The method of claim 11, wherein the on-chip module is a delay-locked loop device.

19. An apparatus, comprising:

a voltage regulator operable to:

regulate a supply voltage to an on-chip module having an operational current;

draw a supply current; and supply the operation current to the on-chip module;

wherein the supply current drawn by the voltage regulator is proportional to the operating current of the on-chip module; and a current source that supplies the voltage regulator with a variable source current, the current source comprising a replica of a component of the on-chip module that is biased such that the variable source current supplied by the current source is equal to the maximum anticipated operational current required by the on-chip module, the maximum anticipated operational current required by the on-chip module being defined as the operational current of the on-chip module when the on-chip module operates at its maximum anticipated frequency;

wherein the voltage regulator supplies the operating current of the on-chip module based at least on the variable source current.

20. The apparatus of claim 19, wherein:

the on-chip module is a phase-locked loop device including a plurality of half-buffers; and the current source is a replica of one of the plurality of half-buffers.

* * * * *